United States Patent [19]

Free

[11] Patent Number: 4,635,383

[45] Date of Patent: Jan. 13, 1987

[54] ROOFING CLEAT CONSTRUCTION

[76] Inventor: Terard L. Free, 13995 E. Utah Cir., Aurora, Colo. 80012

[21] Appl. No.: 808,754

[22] Filed: Dec. 13, 1985

[51] Int. Cl.[4] ..... A43B 3/16

[52] U.S. Cl. ..... 36/7.6; 36/113; 36/134

[58] Field of Search ..... 36/7.6, 113, 134, 97, 36/107, 114, 62

[56] References Cited

U.S. PATENT DOCUMENTS

| | | | |
|---|---|---|---|
| 1,098,232 | 5/1914 | Decius | 36/7.6 |
| 1,229,406 | 6/1917 | Brehm | 36/7.6 |
| 2,189,884 | 2/1940 | Dow | 36/7.6 |
| 2,237,549 | 4/1941 | Cox | 36/134 |
| 2,726,461 | 12/1955 | Smith | 36/76 |
| 2,746,174 | 5/1956 | Patterson | 36/134 |
| 3,021,617 | 2/1962 | Koch | 36/7.6 |
| 3,914,882 | 10/1975 | Greer | 36/62 |
| 4,302,890 | 12/1981 | Covell | 36/7.6 |
| 4,344,238 | 8/1982 | Peyser | 36/10 |
| 4,353,172 | 10/1982 | Bryant | 36/7.6 |
| 4,525,939 | 7/1985 | McNeil | 36/7.6 |

FOREIGN PATENT DOCUMENTS

| | | | |
|---|---|---|---|
| 1112865 | 11/1981 | Canada | 36/134 |

*Primary Examiner*—Werner H. Schroeder
*Assistant Examiner*—Mary A. Ellis
*Attorney, Agent, or Firm*—Henderson & Sturm

[57] ABSTRACT

A roofing cleat apparatus (10) for releasable attachment to workshoes (100) wherein the apparatus (10) comprises a reinforced heel unit (11), a reinforced sole/toe unit (12), an intermediate connecting unit (13), and releasable securing means (14); wherein said heel unit (11) and said toe/sole unit (12) are provided with a plurality of outwardly and downwardly projecting spike or cleat elements (22') for engaging uphill or downhill angled roof surfaces.

1 Claim, 8 Drawing Figures

FIG. 1.
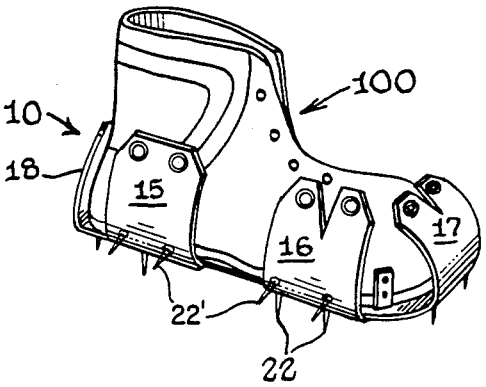
FIG. 2.
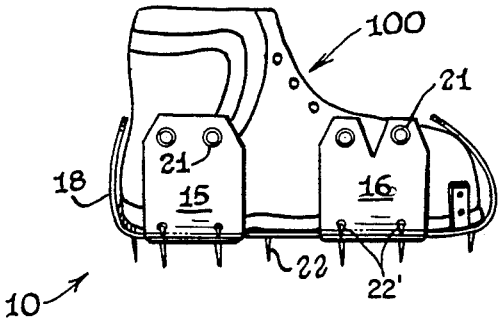
FIG. 3.
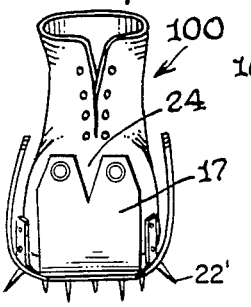
FIG. 4.
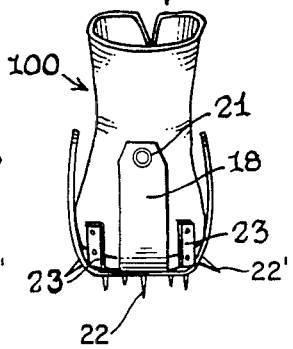
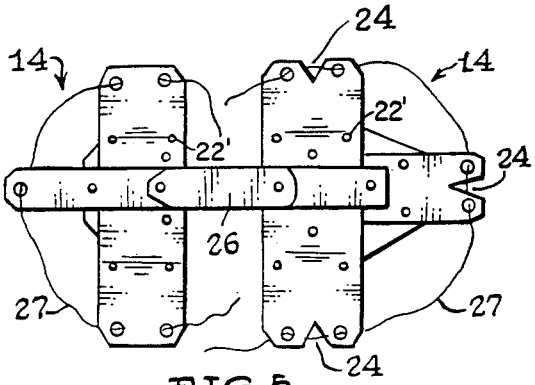
FIG. 5.
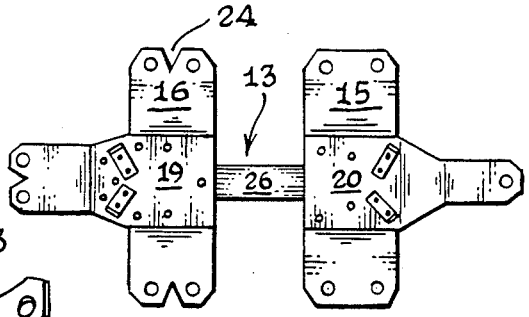
FIG. 6.
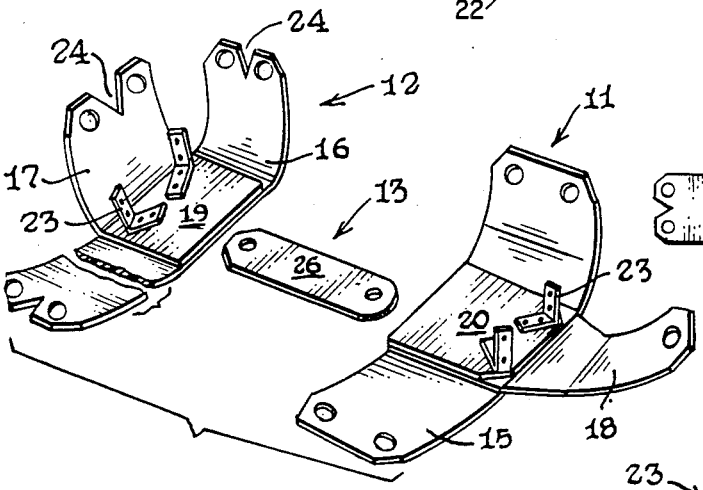
FIG. 7.
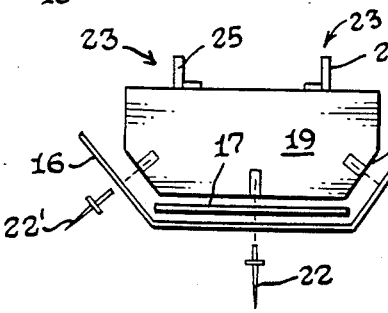
FIG. 8.

ROOFING CLEAT CONSTRUCTION

TECHNICAL FIELD

The present invention relates generally to the field of specialized shoe constructions.

BACKGROUND OF THE INVENTION

The prior art is replete with add-on cleat arrangements for shoes to improve traction, as can be seen by reference to the following U.S. Pat. Nos. 4,302,890; 4,353,172; 4,344,238; and 3,914,882.

While all of these prior art arrangements are more than adequate for their intended purposes, each of them is specifically designed for a particular environment, and as such their constructions are as diverse as the environments in which they are employed.

As a result of the foregoing situation, while the prior art is admittedly crowded, it was also improvements and advancements in this broad area of technology; and, that realization prompted the development of the subject matter that forms the basis of the present invention.

SUMMARY OF THE INVENTION

While the end product of this invention bears a strong general resemblance to the acknowledged prior art structures, the present invention also embodies a unique cooperation between the major support elements that is neither taught nor suggested by the prior art.

Briefly stated the present invention involves an apparatus comprising: a reinforced spiked sole/toe unit; an intermediate connecting unit; and, securing means for temporarily affixing the apparatus over a workman's shoes.

In essence the main features of novelty to be found in this invention resides in the cooperation between the structural features that comprise the heel unit and the sole/toe unit; wherein the overlapping lateral and transverse components of these units not only simplifies the fabrication of the apparatus but also produces reinforcement in the areas which experience the most stress.

BRIEF DESCRIPTION OF THE DRAWINGS

These and other objects, advantages, and novel features of the invention will become apparent from the detailed description of the preferred mode for carrying out the invention which follows; particularly when considered in conjunction with the accompanying drawings wherein:

FIG. 1 is a perspective view of the apparatus disposed on a work shoe;

FIG. 2 is a side elevation view of the subject matter of FIG. 1;

FIGS. 3 and 4 are front and rear elevation views of the subject matter of FIG. 1;

FIG. 5 is a top plan view of the apparatus;

FIG. 6 is a bottom plan view of the apparatus;

FIG. 7 is an exploded perspective view of the apparatus; and

FIG. 8 is an exploded cross-sectional view of a portion of the apparatus.

BEST MODE FOR CARRYING OUT THE INVENTION

As can be seen by reference to the drawings the roofing cleat apparatus is designated generally by the reference numeral (10). The apparatus (10) is intended to be releasably attached to workshoes (100) or the like, and comprises in general: a reinforced heel unit (11); a reinforced sole/toe unit (12); an intermediate connecting unit (13); and, releasable securing means (14). These units will now be described in seriation fashion.

As can best be seen by reference to FIG. 7, both the heel unit (11) and the toe/sole unit (12) are provided with almost identical elongated generally rectangular flexible lateral members (15) and (16) respectively. In addition, the toe/sole unit (12) is provided with an elongated generally rectangular transverse flexible member (17); and, the heel unit (11) is provided with a transverse elongated quasi-triangular member (18). Each of these units is also provided with a thick contoured rigid reinforcing element (19) and (20) respectively, to which the previously mentioned flexible members are fixedly secured.

It should also be noted at this point that the free ends of the lateral and transverse members on both the heel unit (11) and toe/sole unit (12) are each provided with at least one reinforced aperture (21) disposed proximate their ends.

It should further be noted that the reinforcing elements (19) and (20) not only provide an anchor surface for a plurality of replaceable spike elements (22) as will be explained further on in the specification; but, also are provided on their outboard ends with upwardly projecting rigid work shoe engaging elements (23), whose purpose and function will also be explained further on in the specification.

The major structural distinctions between the heel unit (11) and the toe/sole unit (12), as can be seen from the drawings; involves the general configuration of the transverse flexible members (17) and (18), coupled with the fact that the free ends of the lateral (16) and transverse (17) flexible members of the toe/sole unit (12) are further provided with elongated generally V-shaped soles (24), which give added flexibility to the toe/sole unit (12), to enable it to conform to the complementary portion of the workshoe (100).

In order to produce the desired degree of flexibility in combination with strength, lateral rigidity and ability to resist penetration and stretching, the chosen material used in the fabrication of the outer flexible portions of the apparatus (10) comprises relatively thick sheets of plastic material which are severed and configured to form the lateral and transverse flexible members.

The reinforcing elements (19) and (20) on the other hand, only require substantial rigidity and thickness that provides both: protection for the bottom of a workman's feet; and, a substantial anchoring surface for the spikes (22) and the rigid shoe engaging elements (23). With those considerations in mind the preferred materials for the reinforcing elements (19) and (20) would be hard rubber, plastic or wood. In addition to these materials being readily available and inexpensive, they are also attractive from the standpoint that they may be readily trimmed, or otherwise contoured, to produce angled side walls (19') and (20') for the purpose of receiving angled spikes (22') which project outwardly and downwardly from the sides and front of the apparatus (10).

As can best be seen by reference to FIGS. 5 and 8 the respective bottom of the heel unit (11) and the sole/toe unit (12) are each provided with a substantially equal number of downwardly projecting spikes (22); whereas the periphery of the sole/toe unit is provided with a substantially greater number of outwardly projecting spikes (22') than the periphery of the heel unit. The primary reason for the disposition and disparity of the spikes (22) and (22') being to provide downhill support on either side of the apparatus (10) while limiting the number of spikes that normally contact the roof surface.

Obviously a roofer will change his or her orientation with respect to the roof slope many times in the course of a day, and innumerable times over the course of a roofing job. The aforementioned arrangement not only allows freedom of movement, but also safety and peace of mind as a roofer transverses even the most steeply sloped roof surface.

Continuing with the description of the structural components that comprise the apparatus; as can best be seen by reference to FIGS. 6 thru 8, the rigid shoe engaging elements (23) comprise generally L-shaped brackets (25) that are secured by any suitable securing means to the upper surface of the reinforcing elements (19) and (20) and disposed on the outboard ends of those elements.

The connecting unit (13) is disposed intermediate the heel unit (11) and the toe/sole unit (12), and comprises an elongated generally rigid strap member (26) which is secured on its opposite ends to the reinforcing elements (19) and (20). The releasable securing means (14) comprise one or more lacing elements (27) which are threaded through the reinforced apertures (21) in a well recognized manner to secure the apparatus (10) to the workshoe (100).

Having thereby described the subject matter of this invention it should be obvious that many substitutions, variations and modifications of the apparatus (10) are possible in light of the above teachings. It is therefore to be understood that the invention as taught and described herein is only to be limited to the extent of the breadth and scope of the appended claims.

I claim:

1. A cleat apparatus for releasable attachment to work shoes wherein said cleat apparatus consists of:

a reinforced heel unit and a reinforced toe/sole unit wherein both said heel unit and said toe-sole unit comprise: a generaly flexible transverse member; a generally flexible lateral member; and a generally rigid and relatively thick reinforcing element having a flat bottom and outwardly angle side walls; wherein, said transverse members are operatively connected on one end to the respective reinforcing elements; said lateral members are operatively connected in the middle to the respective reinforcing elements; and the free ends of said lateral and transverse members are each provided with at least one reinforced aperture;

an intermediate connecting unit connecting said heel unit to said toe/sole unit;

a releasable securing means operatively associated with the said reinforced apetures for attaching said cleat apparatus to work shoes; and, a plurality of spike elements operatively connected to the flat bottoms and angled side walls of said reinforcing elements to provide both vertically oriented downwardly projecting spike elements and outwardly angled downwardly projecting spike elements one both said heel unit and said toe/sole unit; and, rigid shoe engaging elements operatively associated with the top surface of said reinforcing elements, and comprising generally L-shaped brackets.

* * * * *